United States Patent [19]

Dahlberg

[11] 4,236,989

[45] Dec. 2, 1980

[54] ELECTROLYTIC CELL

[75] Inventor: Lois A. Dahlberg, Corpus Christi, Tex.

[73] Assignee: PPG Industries, Inc., Pittsburgh, Pa.

[21] Appl. No.: 922,716

[22] Filed: Jul. 7, 1978

[51] Int. Cl.[3] ..... C25B 13/02; C25B 13/04; C25B 11/03

[52] U.S. Cl. ..... 204/252; 204/256; 204/258; 204/266; 204/283

[58] Field of Search ..... 204/252, 263–266, 204/256, 258, 283, 282

[56] References Cited

U.S. PATENT DOCUMENTS

| | | | |
|---|---|---|---|
| 3,809,630 | 5/1974 | De Nora et al. | 204/263 X |
| 4,013,536 | 3/1977 | Carbaraux | 204/266 |
| 4,036,727 | 7/1977 | Rahn | 204/254 X |
| 4,056,459 | 11/1977 | Ritti et al. | 204/256 X |

*Primary Examiner*—John H. Mack

*Assistant Examiner*—D. R. Valentine

*Attorney, Agent, or Firm*—Richard M. Goldman

[57] ABSTRACT

Disclosed is an electrolytic cell having an electrode pair of interleaved anode and cathode fingers with a synthetic separator, i.e., a permionic membrane or a microporous diaphragm, therebetween. At least one of the two electrodes of the electrode pair has a continuous electrodic surface with fluid impermeable members at opposite ends of the continuous electrodic surface and a synthetic separator sealably mounted at the fluid impermeable surfaces and extending over the face of the electrodic surface between the members of the electrode pair. The fluid impermeable members at the opposite ends of the continuous electrodic surface may either be the cell body itself or liquid impermeable elements, such as compressive masks, at opposite edges of the finger-like electrode sheets, maintaining the separator against the finger-like electrode sheet, and providing an electrolyte-tight seal therebetween.

7 Claims, 10 Drawing Figures

FIG. 9
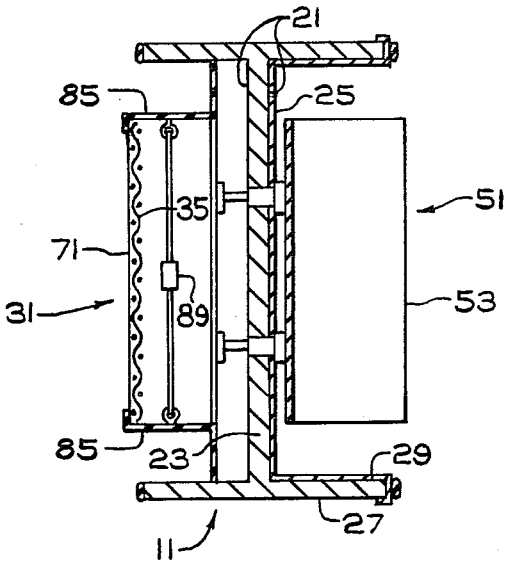
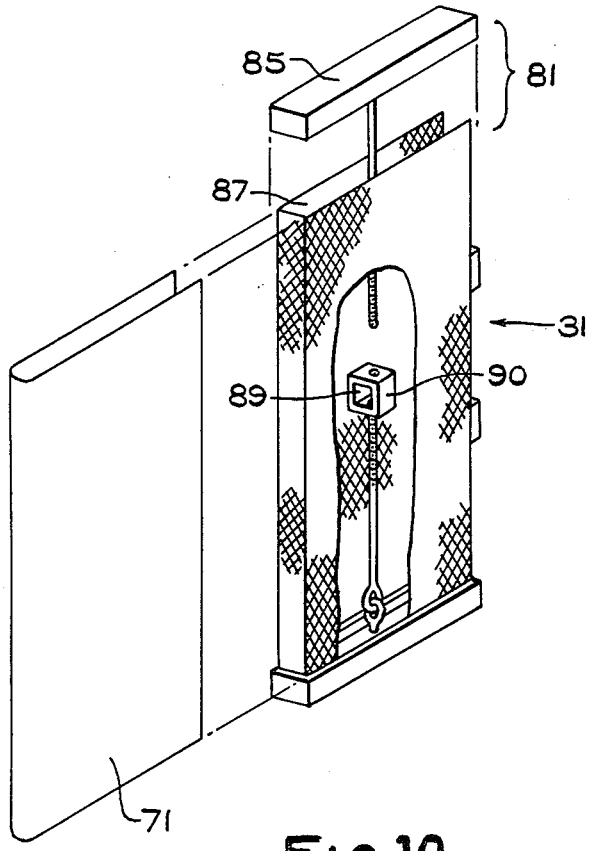
FIG. 10

ELECTROLYTIC CELL

BACKGROUND OF THE INVENTION

Aqueous alkali metal halide brines are electrolyzed to yield chlorine and alkali metal hydroxide, e.g., caustic soda or caustic potash. One method of electrolysis producing an alkali metal hydroxide cell liquor is in an electrolytic cell having the anode separated from the cathode by a permionic membrane. Another method of electrolysis producing a cell liquor of alkali metal hydroxide and alkali metal chloride is in an electrolytic cell having a synthetic microporous diaphragm between the anode and the cathode.

In an electrolytic cell having the anolyte separated from the catholyte by a separator, alkali metal chloride brine is fed to the anolyte compartment and chlorine is evolved at the anodes. This gives rise to a froth of chlorine gas and depleted brine which is recovered from the cell, separated into gaseous chlorine and liquid brine fractions with the brine returned to the cell. Additionally, depleted brine may be recovered from the cell, resaturated, and returned to the cell. Alkali metal ion is transported through the synthetic separator to the catholyte compartment where hydrogen and alkali metal hydroxide are produced. Water may be added to the catholyte compartment to control the alkali metal ion content of the catholyte liquor, in this way controlling the efficiency of the cathode reaction.

The electrolytic cell may be in the form of one of a plurality of cells in a bipolar electrolyzer or the electrolytic cell may be monopolar cell. In a bipolar electrolyzer, a plurality of bipolar units are electrically and mechanically in series with the cathodes of one individual electrolytic cell and the anodes of the next adjacent electrolytic cell of the electrolyzer being mounted on a common structural unit, a bipolar unit. The bipolar unit includes a backplate having a catholyte-resistant member and an anolyte-resistant member.

The cathodic side of the bipolar unit contains a screen spaced from the steel backplate and defining a volume therebetween and hollow cathode fingers extending outwardly from the backplate. The volume within the hollow cathode fingers and the volume between the screen and the backplate define the catholyte volume.

The anodic side of the bipolar unit includes a valve metal backplate with coated valve metal fingers extending outwardly therefrom, substantially parallel to the cathode fingers. The adjacent bipolar units are assembled together to form an electrolytic cell with the anodes of one bipolar unit facing the cathodes of the next adjacent bipolar unit and substantially parallel thereto with a substantially uniform space, i.e., interelectrode gap, therebetween. Either a synthetic permionic membrane or a synthetic microporous diaphragm is positioned between the anode and cathode, dividing the cell into a catholyte compartment and an anolyte compartment.

A bipolar electrolyzer, as described hereinabove, may contain anywhere from two to a hundred or more individual electrolytic cells in the electrolyzer.

Alternatively, the electrolysis may be carried out in a monopolar cell. A monopolar cell has a cathodic half cell containing a screen spaced from an outside wall and defining a volume therebetween and hollow cathode fingers extending outwardly therefrom. The volume within the hollow cathode fingers and between the screen and backplate is the catholyte volume. The anodic element of the monopolar electrolyzer includes a valve metal coating or surface on an internal element of either a peripheral wall or the cell bottom and coated valve metal fingers extending outwardly therefrom. The anodic and cathodic half cells are assembled to form an electrolytic cell with the anodes facing the cathodes and substantially parallel thereto with a substantially uniform space, i.e., an interelectrode gap, therebetween. Additionally, a synthetic separator is positioned between the anode and cathode dividing the cell into a catholyte compartment and an anolyte compartment.

One problem encountered in electrolytic cells having synthetic separators is mounting the separator on an electrode. This becomes a critical problem when there are interleaved electrodes of complex shapes.

Synthetic separators, that is, synthetic halocarbon resins which may have acid groups thereon as exemplified by fluorocarbon resins with carboxylic acid groups, fluorocarbon resins with sulfonic acid groups, and fluorocarbon resins with various derivatives of the aforementioned groups as well as other groups, are difficult to join and require special assembly methods. These special assembly methods include chemical reactions at the laps and joints, heating, and compression.

According to the invention herein contemplated, the use of synthetic separators at electrolytically less active, complex shaped areas of the electrode are dispensed with thereby allowing the use of separators of simple shape. This is accomplished by providing electrolyte impermeable members at opposite ends of the electrode, to hold the permionic membrane in place. The electrolyte impermeable members may be the cell top and cell bottom or they may be flanges or the like held in compression at opposite ends of the electrode.

THE FIGURES

FIG. 9 is a cutaway side elevation of the bipolar unit shown in FIGS. 7 and 8.

FIG. 10 is an exploded view of an electrode useful in the bipolar unit shown in FIGS. 7, 8, and 9.

DETAILED DESCRIPTION OF THE INVENTION

Figure 2:
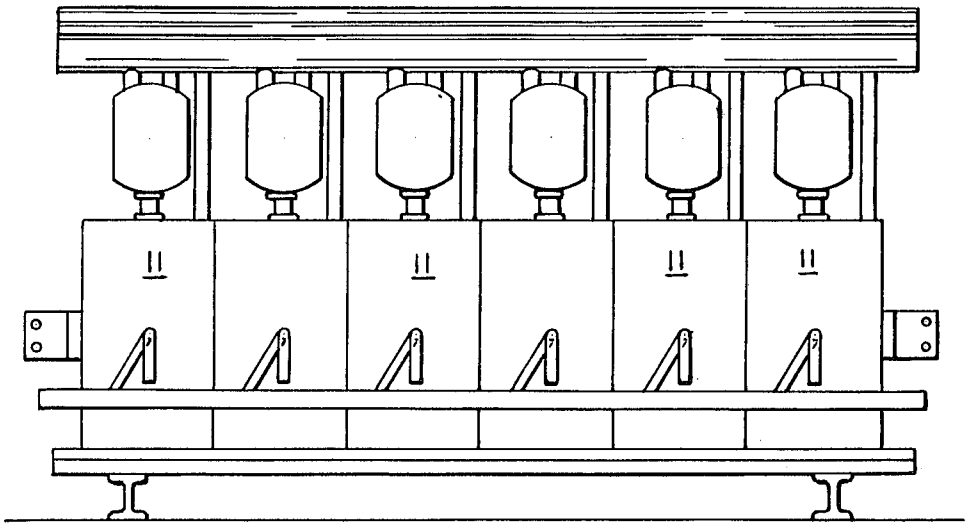
FIG. 2 is a side elevation view of a bipolar electrolyzer.
Figure 1:
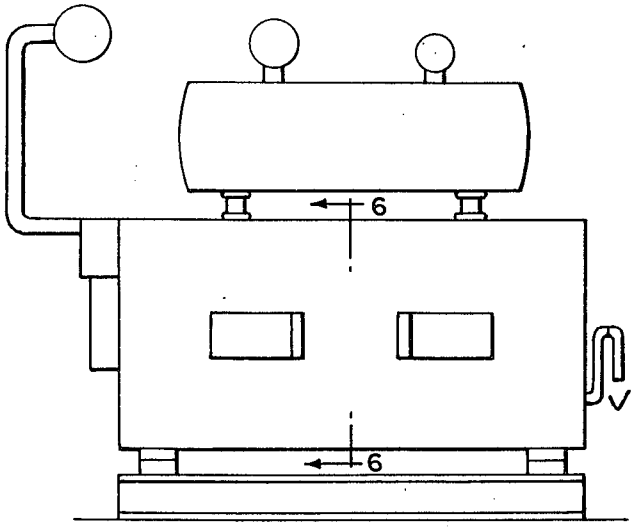
FIG. 1 is a front elevation view of a bipolar electrolyzer.
Figure 3:
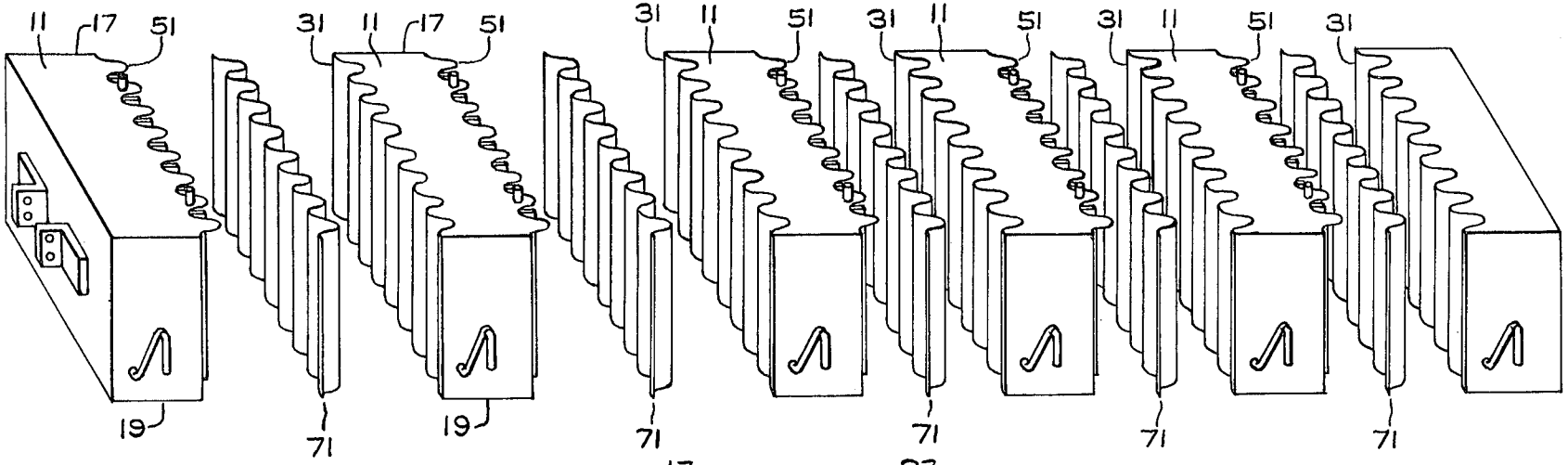
FIG. 3 is an exploded view of a bipolar electrolyzer showing bipolar elements, terminal electrodes, and synthetic separators.

A bipolar electrolyzer 1 is shown generally in FIGS. 1, 2, and 3. The bipolar electrolyzer 1 includes a plurality of bipolar units 11 electrically and mechanically in series with cathodes 31 of one individual electrolytic cell and the anodes of the next adjacent electrolytic cell 15 of the electrolyzer being mounted on a common structural member, i.e., the backplate 21 of the bipolar unit 11.

An individual electrolytic cell 15 is defined by the anodic side 51 of one bipolar unit 11, the cathodic side 31 of the next adjacent bipolar unit 11, and a permionic membrane 71 interposed therebetween.

Figure 6:
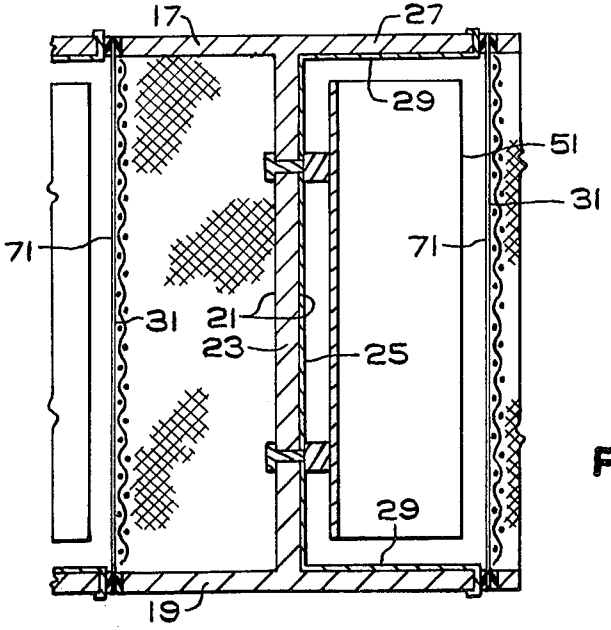
FIG. 6 is a cutaway side elevation of a bipolar unit.
Figure 4:
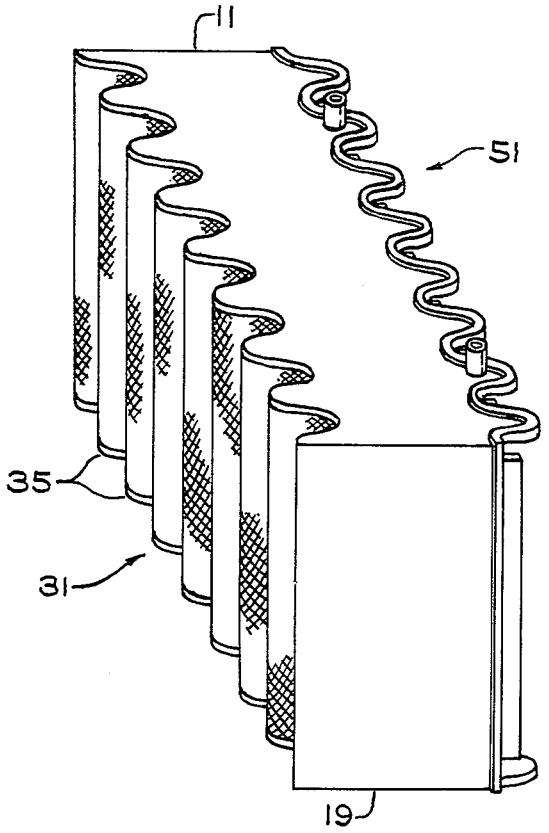
FIG. 4 is an isometric view of a bipolar unit showing the cathodic side.
Figure 5:
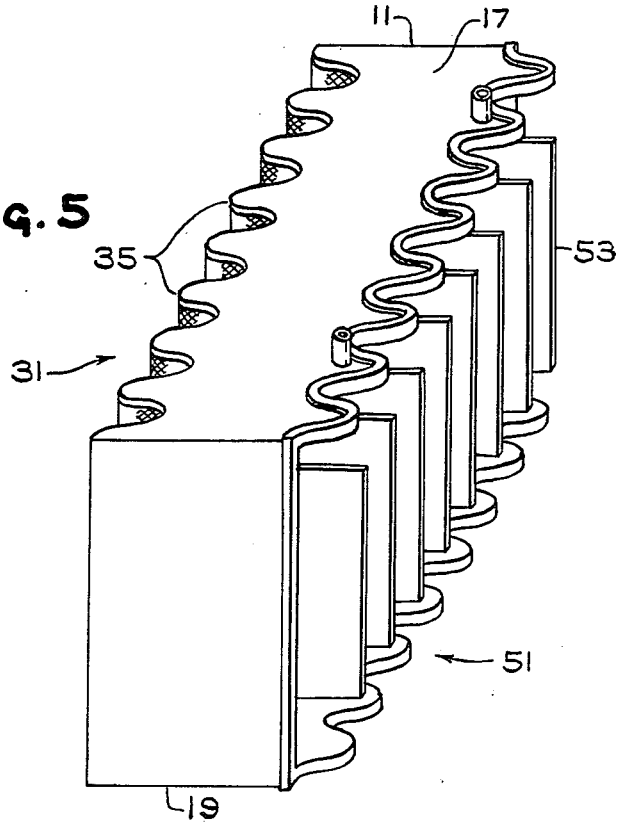
FIG. 5 is an isometric view of a bipolar unit showing the anodic side.
Figure 7:
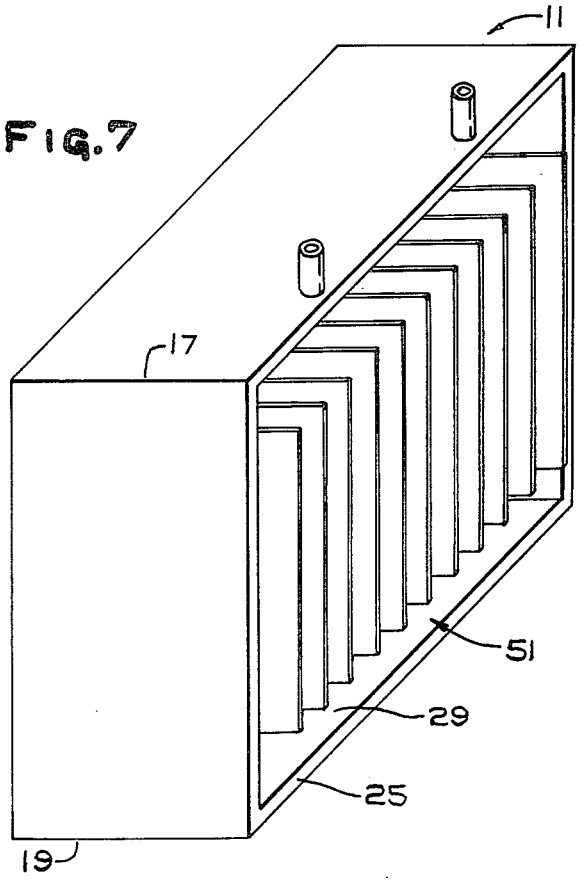
FIG. 7 is an isometric view of a bipolar unit prepared according to an alternative exemplification.
Figure 8:
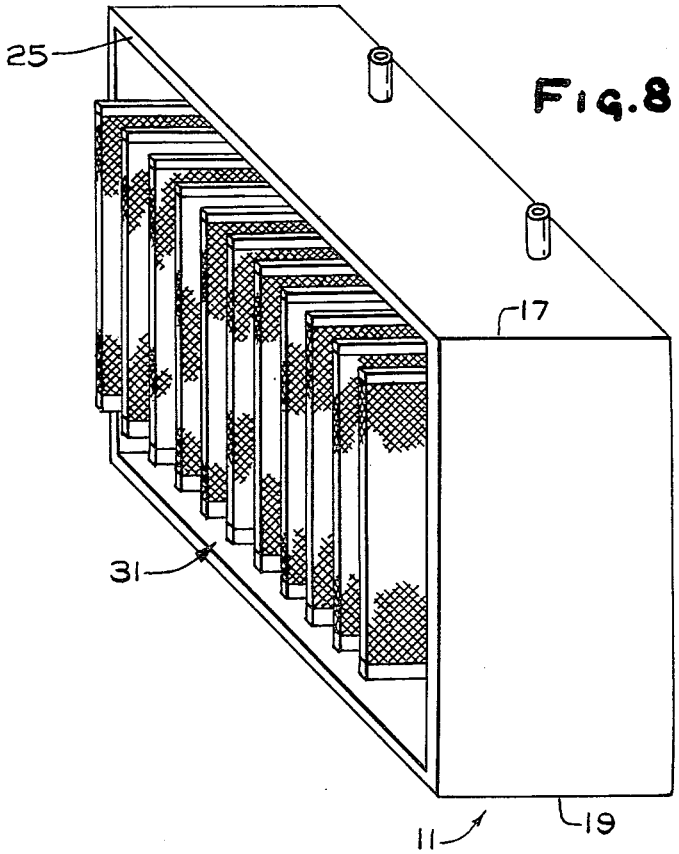
FIG. 8 is an isometric view of the bipolar unit shown in FIG. 7.

The bipolar unit 11 includes a backplate 21 having a cathodic side 31 and an anodic side 51. The backplate 21, shown especially in FIGS. 6 and 9, has a steel plate 23 which is a primary structural member of the bipolar unit 11, and a steel body 25 having peripheral walls 27 around both the cathodic 31 and anodic sides 51 of the bipolar unit 11. The steel plate 23 and steel body 25 are lined with a valve metal sheet 29 on the anodic side of the bipolar unit. The steel plate 23 is of a thickness of from about 1.0 centimeter to about 3.0 centimeters and the valve metal sheet 29 may be of a thickness of from about 2 to about 5 millimeters.

The cathodic side 31 of the bipolar unit 11 includes a screen 33 spaced from the steel backplate 23 and defining a volume therebetween. The cathodic side of the bipolar unit also has hollow cathode fingers 35 extending outwardly from the steel plate 23 of the bipolar unit 11 and from the screen 33. The volume within the cathode fingers 35 and between the screen 33 and backplate 23 defines the catholyte volume.

The material used in fabricating the screen 33 and the cathode fingers 35 is a perforate or foraminous sheet or plate which may be inward and upward louvered. The material may be wire, screen, ribs, bars, rods, perforated plate, perforated sheet, or the like. The fingers 35 and screen 33 are fabricated out of material that is electrically conductive and substantially chemically resistant to concentrated alkali metal hydroxides and hydrogen under cathodic conditions. Such materials include iron, steel, cobalt, nickel, alloys of iron with cobalt and nickel, and carbon, such as stainless steel, and copper.

Additionally, the cathodic elements may have a suitable catalyst, for example, an electron transfer catalyst or hydrogen evolution catalyst, thereon.

The cathode elements, i.e., the cathode fingers 35, are normally rounded so as to provide a wave form, for example, a continuous wave of cathode fingers, such as sinusoidal wave cathode fingers when looking at the cathodes directly above. Alternatively, the cathode fingers 35 may be individual polyhedrons or even truncated pyramidal cathode fingers 35, especially when the fingers 35 are individually removable from the cathode screen 33.

The anodic side of the bipolar unit includes a valve metal sheet 29 on the backplate 21 and coated valve metal fingers 53. The fingers 53 may be blades substantially parallel to the cathode fingers. Alternatively, the anodic elements may be in wave form, for example, sinusoidal, when looked at from above, substantially parallel to and complementary with the cathode waves 35.

One physical form of the anode elements 53 is a perforate or foraminous sheet or plate, for example, inward and upward louvered mesh or screen or sheet or plate, or alternatively, bars, rods, ribs, wires, or the like.

The anode elements 53 are normally fabricated of a valve metal, that is, a metal that forms a protective oxide coating upon exposure to acidic media under anodic conditions. Such materials include titanium, vanadium, zirconium, columbium, hafnium, tantalum, and tungsten. Most commonly, titanium, tantalum, and their alloys are used with titanium being particularly preferred because of its commercial availability. The anodes 53 further include a surface material of a suitable electrocatalyst, that is, a material that allows electron transfer and catalyzes the evolution of molecular chlorine.

The bipolar electrolyzer 1 is assembled to form individual electrolytic cells 15 with the anodes 51 of the bipolar unit 11 facing the cathodes 31 of the next adjacent bipolar unit 11 such that the anodes 51 are substantially parallel to the cathodes 31 with a substantially uniform space, i.e., interelectrode gap, therebetween.

A synthetic separator 71 is positioned between the anode elements 53 and cathode elements 35, dividing the cell 15 into an anolyte compartment and a catholyte compartment. The synthetic separator may be either a permionic membrane, permeable to the flow of cations and impermeable to the flow of anions, or a microporous diaphragm permeable to the flow of electrolyte.

The electrode structure herein contemplated may also be used in monopolar cells. Monopolar cells include a cathodic half cell with a screen spaced from an outside wall and defining a volume therebetween and hollow cathodic fingers extending outwardly from the screen. The volume within the hollow cathodic fingers and between the screen and wall define the catholyte volume. The screen and cathode fingers are fabricated of the same materials as described with reference to a bipolar electrolyzer and are shaped generally with round edges on the cathode providing a wave form, for example, a continuous wave of the cathodes to cathode screen. Alternatively, individual rectangular or even truncated tetrahedral cathode fingers may be used especially where the cathode fingers are individually removable.

The anodic side is formed of a valve metal, as described above. The anode fingers may be in the form of waves or blades. The waves or blades are substantially parallel to the cathode fingers and spaced substantially uniformly therefrom. The anode elements themselves are formed of the same materials as described hereinabove with respect to bipolar electrolyzers and are assembled together to form an electrolytic cell with the anodes facing the cathodes, substantially parallel thereto and spaced uniformly therefrom. A synthetic separator is spaced therebetween, dividing the cell into a catholyte compartment and an anolyte compartment.

The mounting of the synthetic separator 71 presents special problems in an electrolytic cell having interleaved electrodes of complex shape. The synthetic separator 71 between the anolyte compartment and the catholyte compartment is a thin film, e.g., from about 0.1 mm to about 0.5 mm. It is fabricated of a synthetic halocarbon resin having acid groups thereon. The synthetic separator material is a halogenated polymer having pendant acid groups. Most commonly, the polymer is a highly fluorinated polymer having pendant sulfonic, carboxylic or sulfonamide groups. Such materials are normally supplied as sheets or rolled sheets of material. These highly fluorinated polymers having acid groups require special handling in order to join the sheets together. Such special handling includes reaction to form low melting derivatives prior to bonding followed by further reaction to form ion exchange active forms after bonding or joining, chemical reactions to put bondable groups thereon, heating, and compression at high pressures.

It has now been found advantageous to eliminate the permionic membrane at electrolytically less active areas of the electrode. Electrolyte impermeable members are provided at opposite ends of the electrode holding the permionic membrane in place. These members may be provided at the cell top and bottom or by flanges or blanks held in compression at the top and bottom of the electrode within the cell.

While this invention is described with reference to the separator being on the cathode, it is to be understood that the separator may be on either the anode or the cathode or on both electrodes. Synthetic separators may be mounted nearer the anode than the cathode and even on the anode whereby to effect certain advantages.

In the electrolytic cell 1 herein contemplated, there is an electrode pair of fingered, interleaved anodes 51 and cathodes 31. At least one member of the electrode pair has an electrode sheet which is preferably either smoothly continuous, for example, as a wave form sheet shown in FIGS. 3, 4, 5, and 6, or disontinuous in planarity, as, for example, truncated polyhedral as shown in the electrode fingers in FIGS. 7, 8, 9, and 10.

The electrode has fluid impermeable members 81 at opposite sides, that is, edges or ends or top and bottom of the electrode sheet. The synthetic separator 71 is held on the electrode by the electrolyte impermeable members 81. The separator 71 may either lay on the electrodic surface or be spaced therefrom, e.g., by gaskets, spacers, nets, mesh, rods, insulators, or the like.

The use of the impermeable members at the extremities of the electrodes allows for a single sheet of separator without resin-to-resin seals, especially at stress points where there is bending or turning of the membrane such as tops, bottom, and leading edges of electrodes. This avoids chemical, thermal, and hydrostatic working of the membrane at such joints.

FIGS. 3 to 6 inclusive show one exemplification of the electrolytic cell of this invention where the cell body functions as the electrolyte impermeable member. The electrode 35 extends from the top 17 of the cell body to the bottom 19 of the cell body, and the cell body follows the contour of the electrode.

The separator extends from the cell top 17 to the cell bottom 19 and from one side of the cell to the opposite side of the cell, preferably as an unbroken, single sheet. However, laps, for example, with a gasket or other alternative compressive means, may be used.

The electrolyzer 1 has bipolar units 11 with anodic elements 51 and cathodic element 31 separated by a synthetic separator 71. The anodic element 51 includes anodes 53 and anode connectors connecting the anodes 53 to the backplate 21 of the bipolar unit 11 and thence through the backplate 21 to the cathodic element 31 of the bipolar unit 11. The anodic side of the bipolar unit has a titanium lining 29 covering the steel body 25 as described hereinbove.

The cathodic unit 31 includes cathode fingers 35 and cathode screen 33 spaced from the backplate 21 of the bipolar unit 11 and providing an electrolyte volume therein.

The synthetic separator 71 is interposed between the anode 53 and the cathode 35, for example, with suitable, deformable gaskets 91 at bearing surfaces 93 and 95.

According to an alternative exemplification, a removable member 85 on the electrode may function as the liquid impermeable member. In this exemplification, the electrodes do not extend from the top of the cell to the bottom of the cell but rather begin above the cell bottom and terminate below the cell top. For example, when the membrane 71 is on the cathode 35, the cell operates with a positive head on the anode and a negative head on the cathode, while when the separator 71 is on the anode 53 the cell operates with a positive head on the cathode and a negative head on the anode.

The separator 71 extends from the top of the electrode to the bottom of the electrode, preferably fitting under the impermeable member 85 and being held in compression between the lip 37 of the electrode 35 and the impermeable member 85. In this way, an electrolyte tight seal is maintained between the electrode 35, the separator 71, and the impermeable member 85, i.e., the cap.

According to a preferred exemplification, the impermeable member 85 has a lip 87 corresponding to the contour of the open surface 39 of the electrode 35 whereby to further seal the joint.

The bipolar electrolyzer shown in FIGS. 7, 8, 9, and 10 includes bipolar units 11 having anodic elements 51 with anode blades 53 and cathodic elements 31 with cathode screen 33 and cathode fingers 35 extending outwardly from the cathode screen 33 and the bipolar backplate 21.

The separator 71 rests upon one of the electrodes with an electrolyte impermeable member 85 at the top and bottom of the electrode. The electrolyte impermeable member 85 may also be a compressive member held in compression with a turn buckle 89 and bolt 90 whereby to provide an electrolyte tight seal between the impermeable member 85, the separator 71, and the electrode 35.

While the invention has been described with respect to certain exemplifications and embodiments thereof, it is not meant to be limited except as in the claims appended hereto.

I claim:

1. An electrolytic cell comprising an anode and cathode electrode pair of intermeshed vertical electrode surfaces with a synthetic separator therebetween, at least one member of said electrode pair having a continuous electrodic surface with horizontally disposed fluid impermeable members at the top and bottom of said continuous electrodic surface and synthetic separator being sealably mounted at said impermeable members.

2. The electrolytic cell of claim 1 wherein said synthetic separator (permionic membrane) is joined to said electrode at a compression seal between said electrodic surface and said fluid impermeable members whereby to provide a fluid impermeable seal therebetween.

3. The electrolytic cell of claim 1 wherein sain synthetic separator is joined to said electrode at a compression seal between said electrodes.

4. The electrolytic cell of claim 1 wherein the electrode having the continuous electrodic surface is the cathode and the synthetic separator in nearer the cathode.

5. The electrolytic cell of claim 1 wherein the electrode having the continuous electrodic surface is the anode and the synthetic separator is nearer the anode.

6. The electrolytic cell of claim 5 wherein the synthetic separator rests on the anode.

7. An electrode assembly comprising:

a foraminous, metallic, electrode sheet suitable for intermeshing with a complimentary electrode sheet;

a synthetic separator on the outer surface of the electrode sheet; and compressive means at the top and bottom of said electrode sheet, maintaining said synthetic separator against said electrode sheet and providing an electrolyte tight seal therebetween.

* * * * *